US006712745B1

(12) United States Patent
Lynne

(10) Patent No.: US 6,712,745 B1
(45) Date of Patent: Mar. 30, 2004

(54) COVER DEVICE FOR COVERING AN EXERCISE FITNESS BALL AND THE LIKE

(76) Inventor: Judith Lynne, 1606 Garfield Ave., Unit #6, Louisville, CO (US) 80027

( * ) Notice: Subject to any disclaimer, the term of this patent is extended or adjusted under 35 U.S.C. 154(b) by 62 days.

(21) Appl. No.: 10/050,495

(22) Filed: Jan. 16, 2002

Related U.S. Application Data

(60) Provisional application No. 60/262,593, filed on Jan. 17, 2001.

(51) Int. Cl.[7] ..... A63B 71/00

(52) U.S. Cl. ..... 482/148; 446/220; 273/118

(58) Field of Search ..... 482/148; 273/118; 473/569, 52, 351, 378; 446/220

(56) References Cited

U.S. PATENT DOCUMENTS 6,547,703 B1 * 4/2003 Swezey et al. ..... 482/91

* cited by examiner

*Primary Examiner*—Nicholas D. Lucchesi
*Assistant Examiner*—L Amerson
(74) *Attorney, Agent, or Firm*—Emery L. Tracy

(57) ABSTRACT

The present invention is a cover device for covering an exercise fitness ball. The cover device comprises a fabric cover having a perimeter. The fabric cover is positionable over at least one-half of the exercise fitness ball. A fastening mechanism is positioned about the perimeter of the fabric cover for releasably securing the fabric cover to the exercise fitness ball.

18 Claims, 2 Drawing Sheets

COVER DEVICE FOR COVERING AN EXERCISE FITNESS BALL AND THE LIKE

The present application is a continuation of provisional patent application Ser. No. 60/262,593, filed on Jan. 17, 2001, entitled "Fabric Cover for Exercise Fitness Ball".

BACKGROUND OF THE INVENTION

1. Field of the Invention

This invention relates generally to a cover device for covering an object and, more particularly, it relates to a cover device for covering an exercise fitness ball and the like which substantially covers the exercise fitness ball and is releasably secured thereto.

2. Description of the Prior Art

Exercise fitness balls are a popular form of exercise and are commonly used for persons with injuries and other disabilities for rehabilitation and comfort. Some persons use the exercise fitness ball by lying upon the surface of the exercise fitness ball and rolling the exercise fitness ball in various directions on the floor or other substantially flat surface. Other persons use the exercise fitness ball by sitting upon the exercise fitness ball at a desk, at a table, while reading, or while watching television. In these situations, the exercise fitness ball is perfectly suited for promoting comfortable seating, maintaining a proper posture, and minimizing injuries especially those injuries associated with the neck, back, and rear area of the injured or otherwise disabled person.

Typically, the exercise fitness ball is constructed from a durable plastic material and inflated to a predetermined pressure with predetermined resiliency. The exercise fitness balls are manufactured in a variety of shapes and sizes depending on the intended use and desired exercise and/or comfort. For instance, the exercise fitness ball can be substantially spherical with a predetermined diameter. Typical diameters of currently manufactured exercise fitness balls have diameters of approximately sixty-five (65 cm) centimeters and approximately fifty-five (55 cm) centimeters. Other diameters of exercise fitness balls are manufactured depending on the desires of the user. Furthermore, in the alternative, the conventional exercise fitness ball can be substantially "peanut shaped" or any other shape.

Unfortunately, while sitting upon the exercise fitness ball, the user must contact the plastic surface of the exercise fitness ball with his or her body. In colder climates, for instance, the surface temperature of the ball can feel cold and hard to the user as the user mounts the exercise fitness ball. This could possibly deter the user from using the exercise fitness ball during sitting activities for maximum benefit and comfort.

Accordingly, there exists a need for a cover device for covering an exercise fitness ball and the like which provides a comfortable contact between the user and the exercise fitness ball. Additionally, a need exists for a cover device for covering an exercise fitness ball and the like which can be easily and releasably secured to the exercise fitness ball. Furthermore, there exists a need for a cover device for covering an exercise fitness ball and the like which can accommodate a wide variety of exercise fitness balls regardless of size or shape.

SUMMARY

The present invention is a cover device for covering an exercise fitness ball or the like. The cover device comprises a fabric cover having a perimeter. The fabric cover is positionable over at least one-half of the exercise fitness ball. A fastening mechanism is positioned about the perimeter of the fabric cover for releasably securing the fabric cover to the exercise fitness ball.

Additionally, the present invention is a covering for an exercise fitness ball with the exercise fitness ball having a diameter. The covering comprises a covering material having a diameter greater than the diameter of the exercise fitness ball. A cord is positioned about the perimeter of the covering material. A cord-receiving area is formed along the perimeter of the covering material. Tightening means associated with the cord releasably tighten the cord about the exercise fitness ball.

The present invention further includes a method for covering an exercise fitness ball with the exercise fitness ball having a diameter. The method comprises providing a covering material having a diameter greater than the diameter of the exercise fitness ball, positioning a cord about the perimeter of the covering material, folding a portion of the covering material upon itself over the cord along the perimeter of the covering material, securing the folded portion of the covering material over the cord, positioning the covering material over the exercise fitness ball, tightening the cord about the exercise fitness ball, and releasably securing the cord about the exercise fitness ball.

DETAILED DESCRIPTION OF THE PREFERRED EMBODIMENTS

Figure 1:
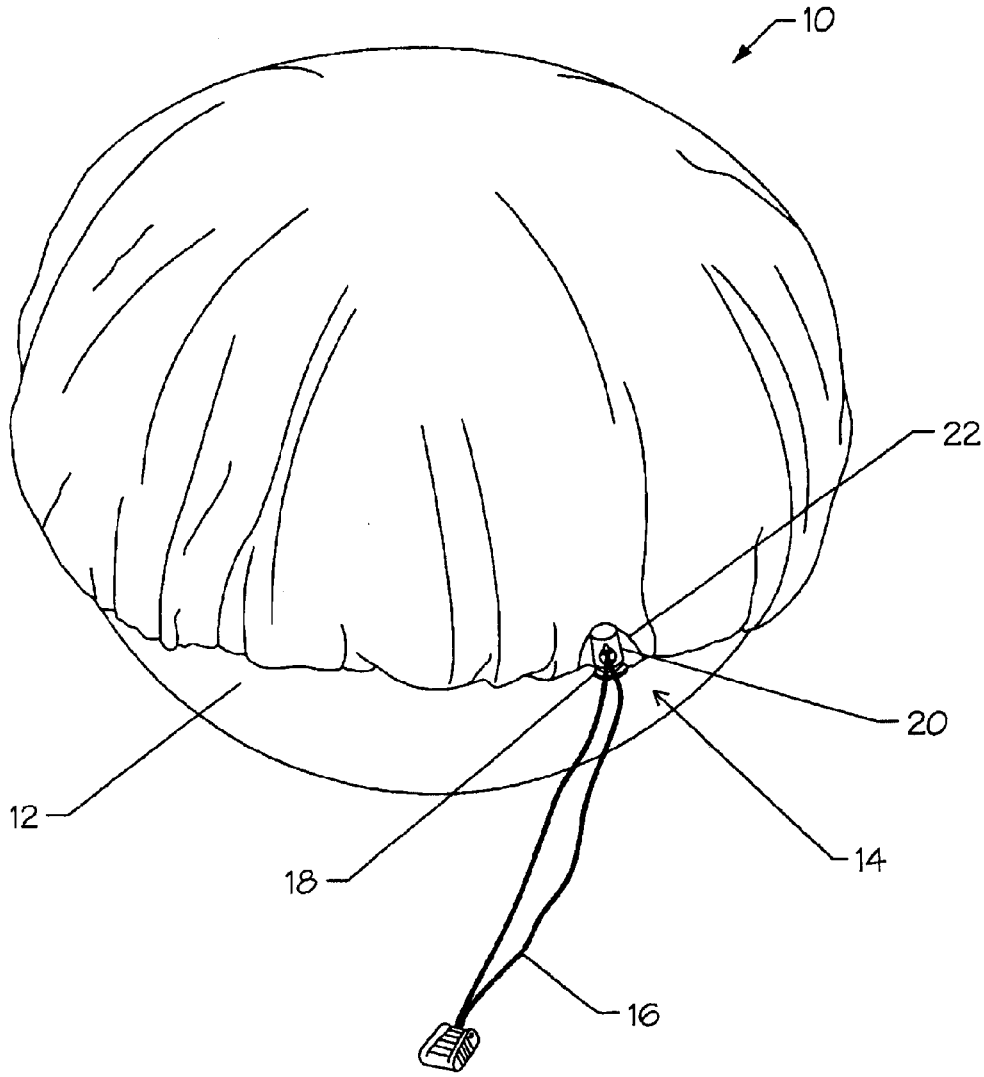
FIG. 1 is a elevational side view of a cover device for covering an exercise fitness ball and the like, constructed in accordance with the present invention.

As illustrated in FIG. 1, the present invention is a cover device, indicated generally at 10, for covering an exercise fitness ball 12 and the like. As discussed above, the exercise fitness ball 12 is typically constructed from a durable plastic material and inflated to a predetermined pressure with predetermined resiliency. While the exercise fitness balls 12 can be manufactured in a variety of shapes and sizes depending on the intended use and desired exercise and/or comfort, the exercise fitness ball 12 as illustrated in FIG. 1 is substantially spherical. It will be understood by a person skilled in the art that while a substantially spherical exercise fitness ball 12 is shown, use of the cover device 10 with other shapes of exercise fitness balls 12 including, but not limited to, "peanut shaped" exercise fitness balls 12 is within the scope of the present invention.

Still referring to FIG. 1, the cover device 10 of the present invention is preferably constructed from a circular piece of fabric having a predetermined diameter depending on the size of the exercise fitness ball 12. The inventor of the present invention has discovered that a cover device 10 constructed from a cotton print fleece or BERBER® (fleece) fabric is perfectly suited for use with the exercise fitness ball 12. A SHERPA® (pile) fabric manufactured by Haber fabrics can also be used. The BERBER® and SHERPA® fabric are beneficial in that they provide a "warm" contact and feel for the user. It should be noted that while the cover device 10 has been described heretofore and will be described hereafter as being constructed from certain fabrics, it is within the scope of the present invention to construct the cover device 10 from any type of fabric material.

With an exercise fitness ball 12 having a diameter of approximately sixty-five (65 cm) centimeters, the cover device 10 preferably has a diameter of approximately fifty-nine (59") inches. With an exercise fitness ball 12 having a diameter of approximately fifty-five (55 cm) centimeters, the cover device 10 preferably has a diameter of approximately forty-three (43 cm) centimeters. While the above-referenced cover device 10 diameters are preferred for a particular-sized exercise fitness ball 12, it should be noted, however, that various sizes of fabric covers can be used with various-sized exercise fitness balls 12. In fact, the cover device 10 can be variably sized and shaped to substantially cover any size or shape exercise fitness ball 12.

The cover device 10 of the present invention further includes a fastening mechanism 14 for releasably fastening the cover device 10 to the exercise fitness ball 12. In a preferred embodiment, the fastening mechanism 14 includes an elastic or bungee cord 16 having a cord lock 18 or other mechanism for releasably securement. In a preferred embodiment, the elastic or bungee cord 16 has a diameter of approximately one-eighth (⅛") inch and a length at least slightly longer than the circumference of the cover device 10. While the elastic or bungee cord 16 has been described as having a diameter of approximately one-eighth (⅛") inch, having an elastic or bungee cord 16 with a diameter greater than approximately one-eighth (⅛") inch and less than approximately one-eighth (⅛") inch is within the scope of the present invention. Further, the cord lock 18 can be any type of locking mechanism which is secured to the ends of the elastic or bungee cord 16 to tighten and releasably secure the elastic or bungee cord 16, as will be described in further detail below.

Preferably, the ends of the elastic or bungee cord 16 are melted or otherwise secured to prevent each end of the elastic or bungee cord 16 from unraveling. Furthermore, a metal or plastic covering (not shown) or the like can be positioned over the ends of the elastic or bungee cord 16 for aesthetic and functionality reasons.

The elastic or bungee cord 16 is secured to the cover device 10 of the present invention by positioning the elastic or bungee cord 16 about the perimeter or circumference of the cover device 10 and folding a portion of the cover device 10 over the elastic or bungee cord 16. Preferably, approximately one (1") inch of the cover device 10 is folded over the elastic or bungee cord 16 although folding more than approximately one (1") inch of the cover device 10 over the elastic or bungee cord 16 or less than approximately one (1") inch of the cover device 10 over the elastic or bungee cord 16 is within the scope of the present invention. The cover device 10 is then secured over the elastic or bungee cord 16 by stitching the fabric material to itself with thread or the like. Preferably, the stitching is performed in a zigzag stitch for secure holding of the elastic or bungee cord 16 therein. It should be noted that other types of stitching and other methods of securing the cover device 10 to itself including, but not limited, to staples, fabric rivets, adhesive, etc., is within the scope of the present invention.

An approximately one (1") inch cut or button hole 20 is formed in the folded portion of the cover device 10 for allowing the ends of the elastic or bungee cord 16 to extend therefrom. Grosgrain ribbon 22 secured in a button hole fashion is secured to the cut area 20 of the cover device 10 to inhibit fraying of the cover device 10.

Figure 2:
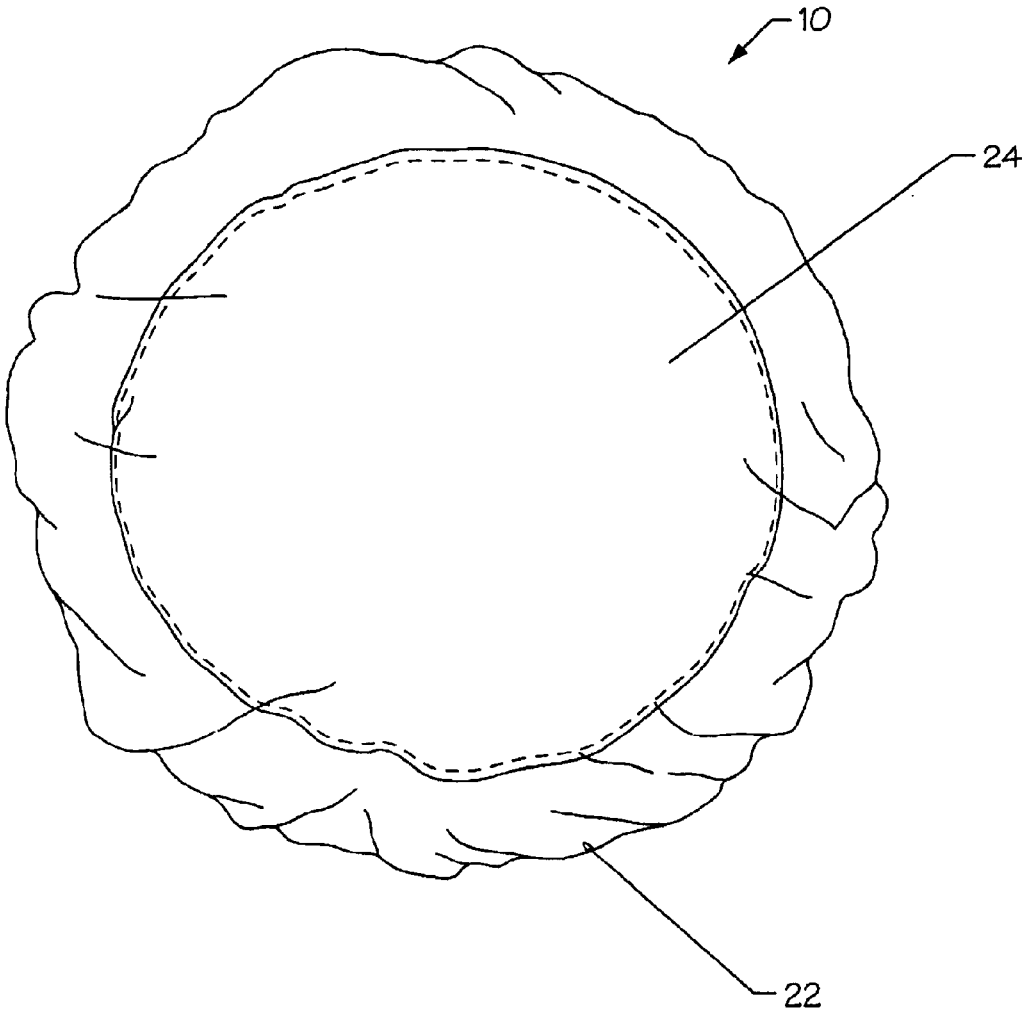
FIG. 2 is top plan view of another embodiment of a cover device for covering an exercise fitness ball and the like, constructed in accordance with the present invention.

In another embodiment of the cover device 10 of the present invention, as illustrated in FIG. 2, the cover device 10 is similar to the embodiment as illustrated in FIG. 1. In this embodiment, the cover device 10 further includes a seat cover 24 (having any size or configuration) secured to the cover device 10 in the substantial center of the cover device 10 by stitching or the like. An underlying batting 26 can be positioned between the seat cover 24 and the cover device 10 for added comfort to the user. Furthermore, preferably, the design of the seat cover 24 is different than, but compatibly matching, the design of the cover device 10.

To position the cover device 10 over the exercise fitness ball 12, the cover device 10 is positioned directly over and onto the exercise fitness ball 12. The elastic or bungee cord 16 is then tightened about the exercise fitness ball 12 and releasably secured about the exercise fitness ball 12 at some point below the center line of the exercise fitness ball 12 by the cord lock 18. Preferably, as mentioned, the cover device 10 is positioned over the exercise fitness ball 12 such that the perimeter of the cover device 10 extends over the centerline of the exercise fitness ball 12. By positioning the cover device 10 in such a manner, the cover device 10 is maintained on the exercise fitness ball 12 while in use by the user.

To remove the cover device 10, the cord lock 18 is released thereby untightening the elastic or bungee cord 16. The cover device 10 can then be easily lifted from the exercise fitness ball 12. Removal of the cover device 10 allows the user to wash and/or otherwise clean the cover device 10 or to use the exercise fitness ball 12 for other activities.

The cover device 10 of the present invention provides a novel and unique approach to creating a comfortable and aesthetically pleasing cover for an exercise fitness ball 12. The user of the exercise fitness ball 12 fitted with the cover device 10 will enjoy additional comfort and benefits associated with the use of the exercise fitness ball 12 in a variety of uses. Furthermore, the cover device 10 can be easily removed for cleaning or replacement, depending on the desires of the user.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A cover device for covering an exercise fitness ball, the cover device comprising:

a fabric cover having a perimeter, the fabric cover positionable over at least one-half of the exercise fitness ball; and fastening means about the perimeter of the fabric cover for releasably securing the fabric cover to the exercise fitness ball;

wherein the perimeter of the fabric cover is folded upon itself forming a cord-receiving area about the perimeter of the fabric cover.

2. The cover device of claim 1 wherein the exercise fitness ball is substantially spherical and the cover device covers more than one-half of the exercise fitness ball.

3. The cover device of claim 1 wherein the fabric cover is substantially circular having a circumferential perimeter.

4. The cover device of claim 1 wherein the folded portion of the fabric cover is secured by stitching.

5. The cover device of claim 1 wherein the cord-receiving area has a slot formed therein, and further wherein the fastening means includes a cord positioned within the cord-receiving area, the cord having a first end and a second end, the first end and the second end extending through the slot in the cord-receiving area.

6. The cover device of claim 5 and further comprising:

a cord lock associated with the first end and the second end of the cord to releasably secure the cord about the exercise fitness ball.

7. The cover device of claim 5 and further comprising:

a covering positioned over the first end and the second end of the cord.

8. The cover device of claim 1 wherein the fastening means is constructed from an elastic material.

9. A cover device for covering an exercise fitness ball or the like, the cover device comprising:

a fabric cover having a perimeter, the fabric cover positionable over at least one-half of the exercise fitness ball;

fastening means about the perimeter of the fabric cover for releasably securing the fabric cover to the exercise fitness ball; and a seat cover secured to the fabric cover.

10. A covering for an exercise fitness ball, the exercise fitness ball having a diameter, the covering comprising:

a covering material having a diameter greater than the diameter of the exercise fitness ball;

a cord positioned about the perimeter of the covering material;

a cord-receiving area formed along the perimeter of the covering material; and tightening means associated with the cord for releasably tightening the cord about the exercise fitness ball.

11. The covering of claim 10 wherein the cord has a first end and a second end, and further comprising:

a slot formed in the folded portion of the covering material with the first end and the second end of the cord extending from the slot.

12. The covering of claim 11 wherein the first end and the second end of the cord are releasably secured together upon tightening of the cord about the exercise fitness ball.

13. The covering of claim 10 wherein the cord is constructed from an elastic material.

14. A method for covering an exercise fitness ball, the exercise fitness ball having a diameter, the method comprising:

providing a covering material having a diameter greater than the diameter of the exercise fitness ball;

positioning a cord about the perimeter of the covering material;

folding a portion of the covering material upon itself over the cord along the perimeter of the covering material;

securing the folded portion of the covering material over the cord;

positioning the covering material over the exercise fitness ball;

tightening the cord about the exercise fitness ball; and releasably securing the cord about the exercise fitness ball.

15. The method of claim 14 wherein the cord has a first end and a second end, and further comprising:

forming a slot in the folded portion of the covering material; and extending the first end and the second end of the cord from the slot.

16. The method of claim 15 and further comprising:

releasably securing the first end and the second end of the cord together.

17. The method of claim 15 and further comprising:

covering the first end and the second end of the cord.

18. The method of claim 14 wherein the cord is constructed from an elastic material.

* * * * *